United States Patent [19]

Roche et al.

[11] Patent Number: 4,524,832

[45] Date of Patent: Jun. 25, 1985

[54] DIVERTER/BOP SYSTEM AND METHOD FOR A BOTTOM SUPPORTED OFFSHORE DRILLING RIG

[75] Inventors: Joseph R. Roche, Humble; Gabriel G. Alexander, Houston; William L. Carbaugh, Humble, all of Tex.

[73] Assignee: Hydril Company, Los Angeles, Calif.

[21] Appl. No.: 556,626

[22] Filed: Nov. 30, 1983

[51] Int. Cl.[3] ..... E21B 17/01; E21B 17/07; E21B 33/038; E21B 33/076

[52] U.S. Cl. ..... 166/347; 166/360; 166/367

[58] Field of Search ..... 166/338–345, 166/347, 351, 359, 364, 367, 362, 360; 285/330, DIG. 22

[56] References Cited

U.S. PATENT DOCUMENTS

| | | | |
|---|---|---|---|
| 2,452,219 | 10/1948 | Bergvall et al. | 285/DIG. 22 |
| 3,032,125 | 5/1962 | Hiser et al. | 166/341 |
| 3,347,567 | 10/1967 | Watkins | 166/341 |
| 3,465,817 | 9/1969 | Vincent | 166/359 |
| 3,647,245 | 3/1972 | Hanes et al. | 166/367 |
| 3,718,350 | 2/1973 | Klein | 285/DIG. 22 |
| 3,791,442 | 2/1974 | Watkins | 166/359 |
| 3,889,747 | 6/1975 | Regan et al. | 166/359 |
| 3,948,547 | 4/1976 | Gache | 285/DIG. 22 |
| 4,138,148 | 2/1979 | Zaremba | 166/340 |
| 4,456,063 | 6/1984 | Roche | 166/84 |

OTHER PUBLICATIONS

Catalog 822 of the Hydril Company, published 1982.

Brochure for the KFDJ Platform Diverter System of Hughes Offshore Company, copyright 1983.

*Primary Examiner*—Stephen J. Novosad

*Assistant Examiner*—Bruce M. Kisliuk

*Attorney, Agent, or Firm*—Dodge & Bush

[57] ABSTRACT

A system and method for installing a fluid flow controller and telescoping spools beneath an offshore bottom supported drilling rig rotary table is disclosed. Upper and lower telescoping spools are provided for initially connecting a Diverter/BOP convertible fluid flow controller between structural casing in the well and a permanent housing beneath the drilling rig rotary table. Clamp means are provided for clamping the rig vent line to an opening in the housing wall of the fluid flow controller during drilling of the borehole through the structural casing in preparation for setting and cementing the conductor casing. In that mode, the system is adapted as a diverter system. After the well is drilled for the conductor casing and the conductor casing is cemented and cut off at its top, a mandrel is fitted at the top of the conductor casing to which the lower end of the lower spool may be connected. The system may be used in this configuration as a diverter system, or after removal of the vent line and connection of a kill line to the housing outlet, the system may be used as a low pressure blowout preventer system.

16 Claims, 4 Drawing Figures

FIG. 3
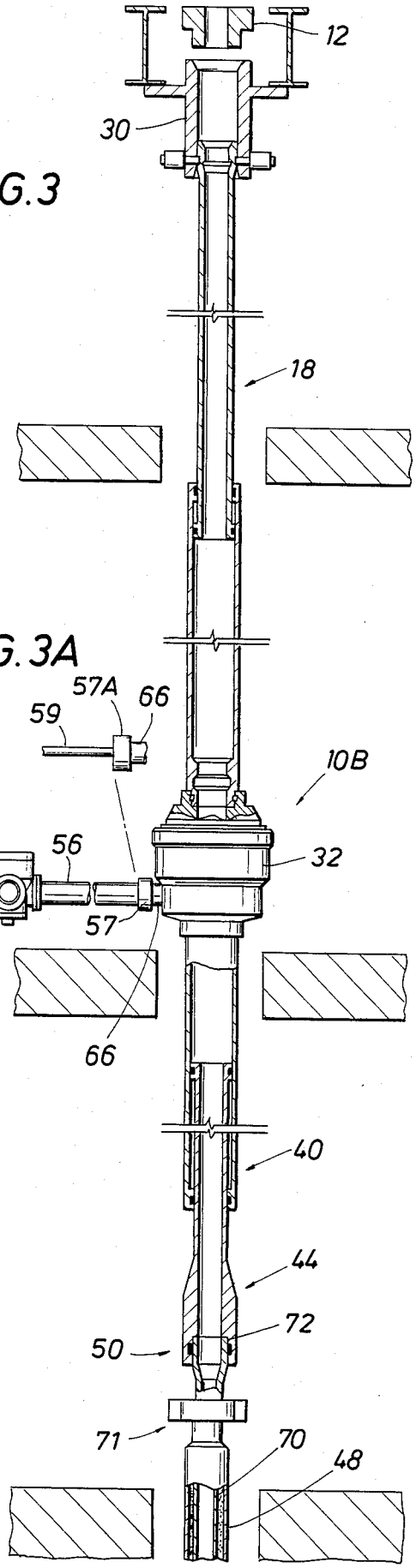
FIG. 3A
FIG. 4
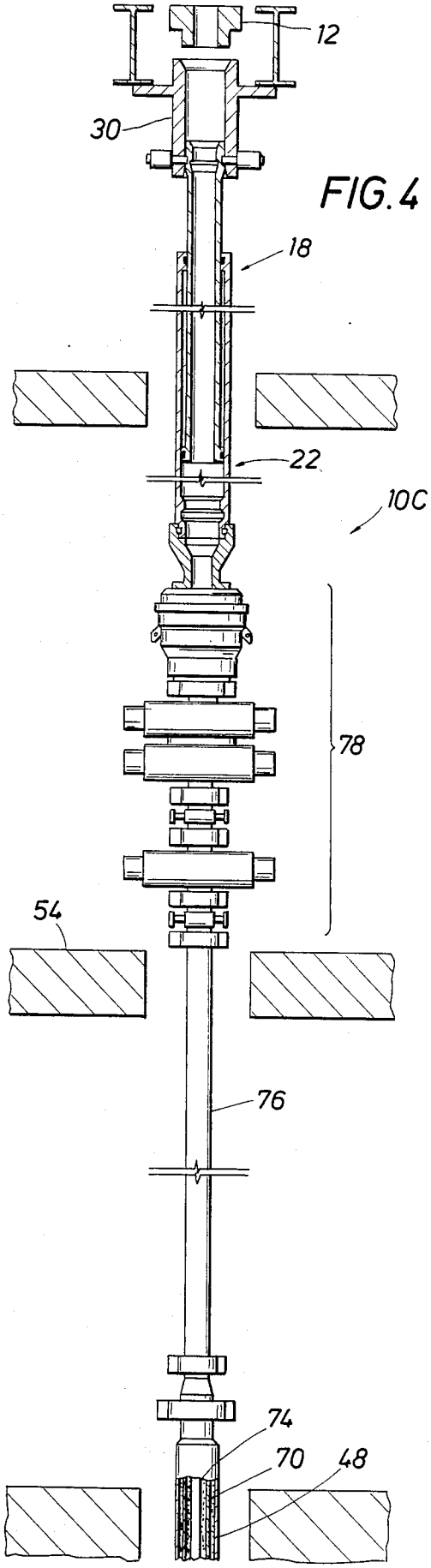

DIVERTER/BOP SYSTEM AND METHOD FOR A BOTTOM SUPPORTED OFFSHORE DRILLING RIG

BACKGROUND OF THE INVENTION

1. Field of the Invention

This invention relates in general to diverters and blowout preventer systems for drilling rigs. In particular, the invention relates to diverter and blowout preventer systems and methods for use with bottom supported offshore drilling rigs.

2. Description of the Prior Art

Diverter systems for bottom supported offshore drilling rigs are known in which a diverter element is provided in the support housing attached to the support beams beneath the drilling rig rotary table. Such diverter systems have provided for a vent line and a flow line in the permanent housing beneath the rotary table. Such systems have required external valve systems in the vent line to assure that when the diverter in the permanent housing opens the fluid system to the vent line, the flow may be directed away from the drilling rig. In such prior art systems, a spacer spool has been provided beneath the support housing and a thirty (30) inch overshot connection has been provided between the spacer spool and the thirty (30) inch outside diameter drive pipe or structural casing.

Fatal and costly accidents have resulted from the complexity of prior art diverter systems described above. Typical prior art diverter systems have included an annulus closing device, external vent and flow line valves, actuators, limit switches and sequenced controls. This complicated valving and piping of the prior art has been further complicated by the inherent risks of manipulating loose packer inserts into the diverter itself. The complexity of the prior art systems has invited a variety of human error and equipment malfunctions.

One problem with the prior art systems has involved the use of external valving in the diverter system. Valves which are external to the diverter unit not only add clutter to the diverter system and the rig configuration, it has also required multiple control functions which are required to operate perfectly. For example, the prior art diverter system valves have required an actuating pressure signal that is regulated to a discrete pressure level different from the operating pressure level of the diverter unit. The need for separate and different control functions executed in only one safe sequence has required separate pressure regulators and connecting components that are in different locations on the underside of the rig floor. Such a requirement has invited mistakes and malfunctions.

In addition to the problem of multiple control functions, there has existed problems with crossed connections in prior art diverter systems. Misconnection of control lines can cause a valve to be closed when it should be open which could result in an explosion in the diverter or breach of the casing.

Another problem of the prior art diverter systems has been exposure to the marine environment of delicate parts such as hydraulic tubing and fittings, limit switches, mechanical linkages and valve actuators. Such exposure has in the past caused breakage and damage to such parts. System malfunctions which result from damage to exposure can be catastrophic.

Another problem of prior art diverter systems has been the result of vent line blockage. Because the vent valve has been remote from the diverter unit itself, a stagnate space has existed at a critical location in the vent line. Buildup of solids and caking of mud in such a dead space may cause the critically important vent line to be choked off. A restricted or shut-off vent line may cause a dangerous pressure increase while being called upon to divert.

Still another problem of prior art diverter systems has involved the use of component sources from a number of different manufactures. The annulus closing device, vent and flow line valves, actuators, sequencing devices and control system components have typically been provided by a different manufacturer. Rig operating personnel are usually burdened with devising the vent line valve circuit interconnecting the components (which are often widely physically separated when installed) and stocking a varied assortment of spare parts using extraordinary caution to avoid misconnections and keeping a number of rig personnel trained to operate and maintain a diverse assortment of complicated components.

Still another problem of prior art diverter systems for bottom supported rigs has been the requirement of a high pressure valve in the vent line. Closure of such a valve has enabled the diverter unit to be converted to a blowout preventer after sufficient casing pressure integrity has been established. However, if this valve should inadvertently be closed during an attempt to divert, breach of the casing or explosion of the diverter system could threaten the safety of the rig itself.

Still another problem of prior art diverter systems has been the result of valve mismatch. While many different types of valves have been used in diverter systems, there has been no single valve that has been designed expressly for or is especially well suited to the particular application of a diverter system. Selection of the type, size and rating of such valves has been a vexing puzzle for designers of rig valve systems which has been required to solve usually when a new drilling rig is being built.

Another important disadvantage of the prior art diverter systems has been the necessity to stop drilling operations and manipulate packer inserts to facilitate annulus shut-off. Such a necessity has not only been a time consuming task, it has presented very real hazards. One such hazard has been the problem of forgotten inserts. Often in the course of determined efforts to drill ahead, fetching, installing and latching the packer insert is overlooked. Without such an insert there is no diverter protection. If the insert is in place, but not latched down in prior art diverter systems, the packer insert is potentially a dangerous projectile.

A second problem resulting from the use of packer inserts has been the problem of open hole hazard about the pipe in the hole while the insert is being installed or removed. There has been no protection from the insert type diverter against uncontrolled well fluid flows. Such lack of protection has left a serious safety gap in the drilling operation.

Still another problem of the use of packer inserts in the prior art diverter systems has been the problem of forgotten removal. In unlatch and removal of the packer insert has been inadvertently overlooked before pulling drill pipe from the hole, centralizers or the bottom hole assembly may be run into the insert, thereby endangering the drilling crew and equipment.

Still another problem of the use of packer inserts in the prior art drilling systems has been the problem of exploding packers. If during testing, the standard packer is not reinforced by an insert and/or a pipe in the hole, the hydraulic fluid pressure may cause the packer to explode, thus jeopardizing the safety of the crew.

Perhaps the most important problem of the prior art diverter systems has been the inherent risk of pressure testing in-situ. Pressure testing of prior art diverter systems has been accomplished by overriding the safety sequencing in the valves so that the vent line valve is closed simultaneously with closure of the annulus. Disastrous results have been experienced when the safety overriding mechanism has been unintentionally left in place when testing was complete and drilling was resumed.

IDENTIFICATION OF OBJECTS OF THE INVENTION

It is therefore a primary objective of this invention to overcome the disadvantages and problems and inherent safety risks of the prior art diverter systems.

It is another object of the invention to provide a diverter system for a bottom founded offshore drilling rig in which the vent line is always open. In other words, it is an object of the invention to provide a system having no valves or other obstructions in the vent line, thereby avoiding the complexity of external valves, valve actuators and valve control functions.

It is a further object of the invention to provide a blast selector/deflector permitting manual preselection of port or starboard venting using a hardened target plug that permits vent flow even during position change.

It is still another object of the invention to provide a single control function for operation of the diverter system. In other words, it is an object to provide on command, a single signal to one component for performing an inherently safe execution of the rerouting of flow of a well kick.

It is another object of the invention to provide a rugged and protected system, one in which no external valve, linkages, limit switches, interconnecting control lines, etc. which may be subject to the breakage of critical parts.

It is another object of the invention to provide a system having no stagnant space, a system in which the vent flow is immediately opened when the diverter system begins to divert fluid away from the well. Avoiding the stagnant space in the system, prohibits caking of solids that may obstruct or shut-off vent flow.

It is still another object of the invention to provide an annular packing unit in a diverter system thereby affording many important safety and operational advantages such as the avoidance of providing inserts when running in and pulling out of the hole during the drilling operation thereby avoiding potentially fatal mistakes of forgetting to fetch, install and latch down inserts. Such advantage also includes the effect of rig time saved.

Another important advantage of the diverter system according to the invention is to provide a diverter system packing unit which can close on open bore thus providing ready assurance of safety in the event of execessive well flow while there is no pipe in the hole and thereby eliminating a serious gap in the safety of the drilling operation of prior art diverter systems.

Another important advantage of the invention is to provide for safe testing with a packing unit which does not directly contact hydraulic fluid during actuation, thereby eliminating the dangers of exploding packers.

It is another object of the invention to provide telescoping spools above and below the diverter blowout preventer unit providing a system which is versatile and time efficient.

It is another object of the invention to provide telescoping spools between the diverter and blowout preventer system which have high strength quick-connect couplings permitting reliable, fast nippling up and down.

SUMMARY OF THE INVENTION

The above identified objects of the invention as well as other advantages and features of the invention flow from a novel system adapted for alternative use as a diverter or a blowout preventer for a bottom supported drilling rig. The system is adapted for connection to a permanent housing attached to rig structure members beneath the drilling rig rotary table. The permanent housing has an outlet connectable to the rig fluid system flow line.

The system according to the invention includes a fluid flow controller having a housing with a lower cylindrical opening and an upper cylindrical opening and a vertical flow path therebetween and an outlet passage provided in the housing wall. An annular packing element is disposed within the housing. An annular piston means adapted for moving from a first position to a second position is provided whereby in the first position the piston means wall prevents interior fluid from communicating with the outlet passage in the housing wall and in the second position, the piston means wall allows fluid communication of interior fluid with the outlet passage and urges the annular packing element to close about an object extending through the bore of the housing or to close the vertical flow path through the housing in the absence of an object in the vertical flow path. Means are provided in the system for connecting alternatively a vent line or choke/kill line to the outlet passage provided in the housing wall.

A lower telescoping spool having a lower connector means at its lower end is provided for connection to structural casing or to a mandrel connected to a conductor string cemented within the structural casing. An upper connection means on the upper part of the lower telescoping spool is provided for connection to the lower cylindrical opening of the fluid flow controller. An upper telescoping spool having a lower connection means for connection to the upper cylindrical opening of the fluid flow controller is also provided.

Advantageously, the lower connector means at the lower end of the lower telescoping spool is an overshot connection. The upper connection means at the upper end of the lower telescoping spool is preferably a snap joint connector. The lower connection means of the upper telescoping spool is likewise preferably a snap joint connector. Dog means provided on the permanent housing connect the upper part of the upper telescoping spool to the permanent housing. The means for alternatively connecting a vent line or a choke/kill line to the outlet passage in the controller housing wall comprises a spool extending from the outlet passage and a clamp means for connecting the spool to the vent line or alternatively to a choke/kill line.

Also, according to the invention, a method is provided for installing a system adapted for alternative use as a diverter or as a blowout preventer for a bottom supported drilling rig beneath the permanent housing attached to rig structure members supporting the drilling rig rotary table after structural casing has been set in a borehole. The method comprises the steps of lowering through the rotary table a collapsed lower telescoping spool having a lower connector means at its lower end and an upper connector means at its upper end. The lower connection means is connected at the lower end of the lower spool to the structural casing in the borehole.

A fluid flow controller having a housing wall outlet and adapted for alternative use as a diverter or blowout preventer is horizontally moved to a drilling rig subsupport structure beneath the rotary table. The controller is fastened to the subsupport structure after the controller is substantially vertically aligned with the bore of the rotary table above and the lower telescoping spool below. The lower telescoping spool is stroked out until the connector means at its upper end connects with the lower end of the controller. A collapsed upper telescoping spool is lowered through the rotary table. The upper telescoping spool has a lower connector means at its lower end which is connected to the upper end of the controller by means of its lower connector means. Next, the upper telescoping spool is stroked out until the upper end of the upper telescoping spool connects with the permanent housing.

A vent line connection to the wall outlet of the controller housing results in a completed system which may be used as a diverter system for drilling the borehole for the conductor string through the structural casing.

After the wall has been drilled for a conductor string and after the conductor string has been cemented in the well, the method, according to the invention, further includes lifting the inner barrel of the lower telescoping spool, cutting off the conductor string, attaching a mandrel having the same outer diameter as that of the structural casing to the top of the conductor string, and lowering the inner barrel of the lower telescoping spool until the lower connection means of the lower spool connects with the mandrel.

The system which results from the above steps may be used as a diverter during drilling through the conductor string. The method described above may further comprise the steps of removing the clamped vent line connection at the wall outlet of the controller housing, installing a reducer hub to a choke/kill line, and clamping the reducer hub to the wall outlet of the controller housing. The system which results from the above series of steps may be used as a blowout preventer during drilling through the conductor string.

The method according to the invention further includes steps after a smaller diameter casing has been submitted into the well. These steps comprise disconnecting the upper telescoping spool from between the flow connector in the rig permanent housing, raising the upper telescoping spool via the rotary table, disconnecting the flow controller from the lower telescoping spool and removing the flow controller to a stowed position of the substructure beneath the rotary table, removing the lower telescoping spool from the mandrel and raising the lower spool via the rotary table, installing a high pressure blowout preventer spool via the rotary table to the smaller diameter casing, installing a high pressure blowout preventer stack in position above the high pressure spool, and lowering the upper telescoping spool via the rotary table for connection between the high pressure blowout preventer stack and the rig permanent housing.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 3 illustrates the invention after a conductor casing has been provided within the structural casing and a mandrel atop an adapter spool has been connected to the conductor casing and the lower part of the lower telescoping spool has been connected thereto. FIG. 3 further illustrates the alternative connection of the choke/kill line to the spool in the flow controller wall; and FIG. 4 illustrates the invention after the casing string has been cemented within the conductor casing and after the lower telescoping spool and fluid flow controller have been removed and replaced by a high pressure blowout preventer stack, a high pressure spool and after the upper telescoping spool has been returned to the top of the blowout preventer stack via the rotary table bore.

DESCRIPTION OF THE INVENTION

Figure 1:
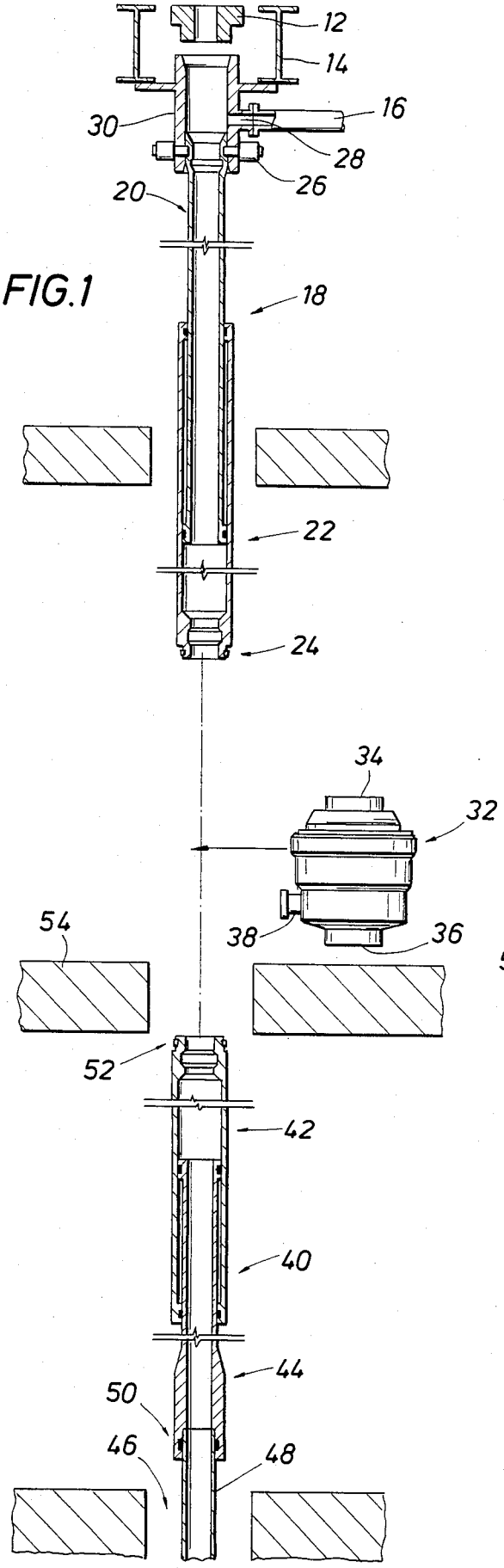
FIG. 1 illustrates the providing of the fluid flow controller and system according to the invention at a structural level beneath the drilling rig rotary table and further illustrating upper and lower telescoping spools being provided through the bore of the rotary table for connection to the fluid flow controller and to the structural casing in the borehole.

FIG. 1 illustrates the apparatus and method for installing a diverter/BOP system between the permanent housing 30 attached to support beams 14 beneath the drilling rig floor. Rotary table 12 has a bore which may be opened to coincide with that of the permanent housing thereby allowing tubular members to be inserted via the bore of the rotary table 12 and the permanent housing 30 to positions below.

Figure 2:
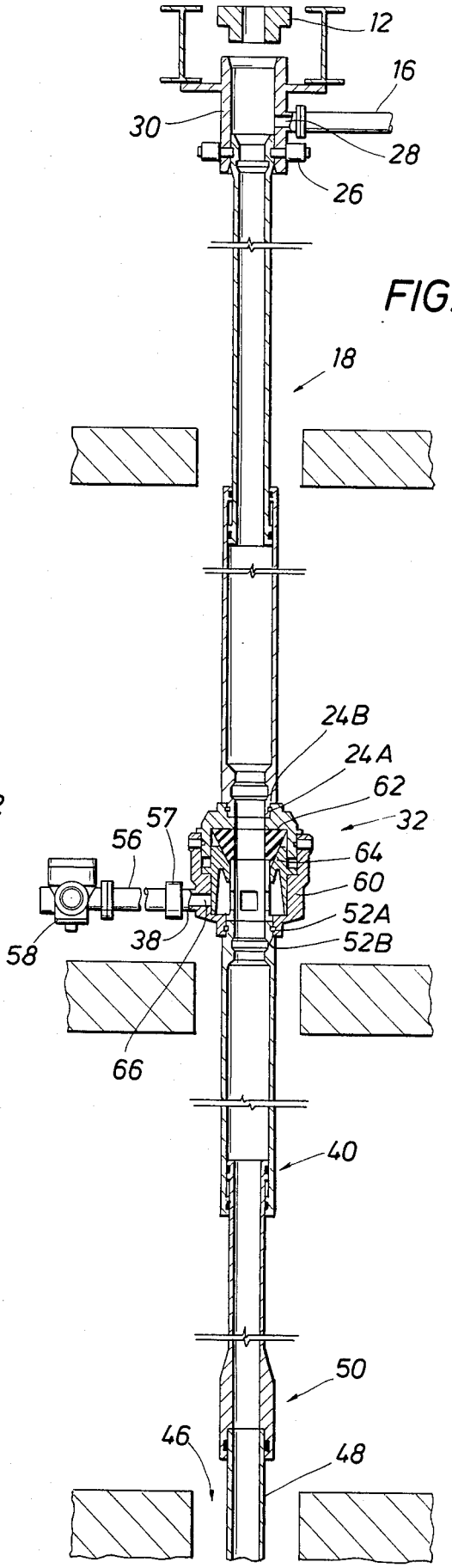
FIG. 2 shows the system according to the invention in which the upper telescoping spool and lower telescoping spool have been connected to the fluid flow controller and further illustrating a vent line connected to an opening in the housing wall of the fluid flow controller.

At the heart of the system and method, according to the invention, is a fluid flow controller 32 having an upper cylindrical opening 34 and a lower cylindrical opening 36 and a spool 38 connected to an outlet passage 66 in the housing wall. The cross-section of the flow controller 32 is illustrated in FIG. 2. The fluid flow controller, according to the invention, is described in detail in U.S. patent application Ser. No. 449,531 assigned to the same assignee as this application is assigned. Such application is incorporated herewith for all purposes.

Briefly, the fluid flow controller includes a housing 60 with a lower cylindrical opening 36 and an upper cylindrical opening 34 and a vertical flow path therebetween. An outlet passage 66 is provided in its wall and communicates with the spool 38. An annular packing element 62 is provided within the housing and an annular piston means 64 is adapted for moving from the first position to a second position whereby in the first position, the piston means wall prevents interior fluid from communicating with the outlet passage 66 in the housing wall and in the second position, the piston means wall allows fluid communication of interior fluid with the outlet passage 66 and urges the annular packing element 62 to close about an object extending through the bore of the housing such as a drill pipe or to close the vertical flow path through the housing in the absence of any object in the vertical flow path.

Returning now to FIG. 1, the fluid flow controller 32 is disposed and stored in the drilling rig in a sublevel illustrated by support member 54. After the initial opening in the sea floor has been provided such as illustrated by borehole 46, a structural casing 48 is provided therein typically having a thirty (30) inch outside diameter. A lower telescoping spool 40 is lowered via the bore of the rotary table 12 through the permanent housing 30 to the proximity of the structural casing 30. A handling tool (not illustrated) lowers the lower telescoping spool until the overshot connection 50 at the lower part of the lower telescoping spool 44 engages the outer diameter of the structural casing 30 providing an overshot connection to it.

Preferably, during this stage of the connection of the lower telescoping spool 40 to the structural casing 30, the lower telescoping spool 40 is collapsed and pinned so that the upper part of the lower telescoping spool is not free to move with respect to the lower part 44 of the lower telescoping spool. Next, the fluid flow controller 32 is moved horizontally into position above the lower telescoping spool 40 and beneath the vertical bore of the permanent housing 30 and the rotary table 12. An upper telescoping spool 18 which is collapsed and pinned is also lowered via the bore of permanent housing 30 and rotary table 12.

A snap ring connector 52 at the top of the upper part 42 of the lower telescoping spool and the snap ring connector 24 at the lower part 22 of the upper telescoping spool 18 provide means for connecting the lower telescoping spool 40 and the upper telescoping spool respectively to the lower cylindrical opening 36 and the upper cylindrical opening 34 of the fluid flow controller 32. The upper part of the lower telescoping spool is then stroked out until the snap ring connector 52 fits within the lower cylindrical opening 36 and the snap ring 52A, illustrated in FIG. 2, snaps over an annular shoulder 52B in the lower cylindrical opening 36 thereby connecting the lower telescoping spool 40 to the fluid flow controller 32.

Next, the snap ring connector 24 of the upper telescoping spool is lowered until it fits within the upper cylindrical opening 34 of the fluid flow controller 32 and snap ring 24A snaps past a shoulder 24B in the upper cylindrical opening 34 providing connection between the upper telescoping spool and the fluid flow controller.

As illustrated in FIG. 2, the upper telescoping spool is then stroked out until the upper part of the upper telescoping spool 20 fits within the permanent housing 30 and the dogs 26 may engage the outer surface of the upper part 20 of the upper telescoping spool thereby connecting it to the permanent housing 30. Thus, in normal operation as illustrated in FIG. 2, the fluid returning from the drilling operation returns via the lower telescoping spool 40, the flow controller 32, the upper telescoping spool 18 and back to the drilling rig fluid system via fluid system flow line 16 connecting with an opening 28 in the permanent housing 30. A clamp 57 clamps the spool 38 connected to the outlet passage 66 to a vent line 56.

A blast deflector 58 described in U.S. patent application Ser. No. 456,206 may advantageously be provided to deflect diverted fluids away from the drilling rig. Such U.S. patent application Ser. No. 456,206 is assigned to the same assignee as the assignee of the present application and is incorporated herewith for all purposes.

The system illustrated in FIG. 2 may advantageously be used as a diverter system during drilling through the structural casing 30 for the purpose of providing the hole for the conductor casing. The system incorporates all of the advantages set out in the "Identification of the Objects of the Invention" section above. According to the invention, a failsafe system is provided requiring no external valving with all the inherent advantages of simplicity, ruggedness and the ability to close about objects in the borehole or even close on open hole. The system is assured of diverting while closing the vertical flow path to the fluid system flow line in the event of a kick in the well.

Turning now to FIG. 3, an illustration of the system is presented after the conductor casing 70 has been run and cemented within the structural casing 48. Typically, the conductor casing 70 has an outside diameter of twenty (20) inches. The conductor casing is provided after the lower telescoping spool 40 has had its overshot connection disconnected from the structural casing 30 and has been stroked upwardly and pinned until the conductor casing 20 may be installed within the structural casing 48. After the conductor casing has been installed, the top of it is cut off and an adapter spool 71 is provided having an upwardly facing mandrel 72 which has an outside diameter equal to that of the structural casing. In other words, the mandrel 72 will typically have an outside diameter of thirty (30) inches, similar to that of the structural casing.

After the mandrel has been installed, the lower telescoping spool may be unpinned and stroked downward until the overshot connection 50 fits about the outside diameter of mandrel 72 providing a fluid tight connection. In this configuration of FIG. 3, further drilling through the conductor casing 70 may continue in the diverter mode. In other words, the clamp 57, vent line 56 and blast deflector 58 may remain in place if the flow controller 32 is to be used as a blast deflector.

On the other hand, the flow controller 32 may be constructed to safely withstand low pressures, for example 2000 psi. Such low pressures may be contained within the conductor casing and mandrel and lower telescoping spool 40. If such a blowout preventer system is desired, the clamp 57 is replaced by a clamp 57A, illustrated in sketch 3A, connecting a choke/kill line to the outlet spool 66 in the housing wall of the fluid flow controller 32. Thus, in the system which results by installing the clamp 57A and choke/kill line 59, complete control over the well may be provided. In the event of a kick or high pressure condition in the well, the well may be completely controlled avoiding the necessity for diverting the high pressure fluid. The well may then be brought under control by either killing the well via tubing 59 or the tubing 59 may be used as a choke line to relieve the pressure in the well.

FIG. 4 illustrates the condition where the well has been drilled through the conductor casing 70 to a point where a casing string 74, typically of $13\frac{5}{8}$ inch diameter, may be landed and cemented within the conductor casing. According to the invention, the lower telescoping spool 40 and the upper telescoping spool 18 illustrated in FIG. 3 may be disconnected from the lower and upper cylindrical openings of the fluid flow controller 32 and the fluid flow controller 32 may be stowed by moving it horizontally away from the drilling path. The upper and lower telescoping spools may then be removed via the bore of the permanent housing 30 and rotary table 12.

Next, a high pressure spool 76 may be provided via the permanent housing 30 and rotary table 12 for connection to the casing string 74. A high pressure blowout preventer stack 78 may then be connected at the drilling rig support member 54 level after which an upper telescoping spool 18 may be lowered via the rotary table 12 and permanent housing 30 and connected to the top of the high pressure blowout preventer stack 78 as previously described.

Various modifications and alterations in the described structures will be apparent to those skilled in the art of the foregoing description which does not depart from the spirit of the invention. For this reason, these changes are desired to be included in the appended claims. The appended claims recite the only limitation of the present invention and the descriptive manner which is employed for setting forth the embodiments and is to be interpreted as illustrative and not limitative.

What is claimed is:

1. A system adapted for alternative use as a diverter or a blowout preventer for a bottom supported drilling rig and adapted for connection to a permanent housing attached to rig structural members beneath a drilling rig rotary table, the permanent housing having an outlet connectable to a rig fluid system flow line, the system comprising a fluid flow controller having a controller housing with a lower cylindrical opening and an upper cylindrical opening and a vertical flow path therebetween and an outlet passage provided in its wall, a packing element disposed within the controller housing, and annular piston means adapted for moving from a first position to a second position, whereby in the first position the piston means wall prevents interior fluid from communicating with the outlet passage in the controller housing wall and in the second position the piston means wall allows fluid communication of interior fluid with the outlet passage and urges the annular packing element to close about an object extending through a bore of the controller housing or to close the vertical flow path through the controller housing in the absence of any object in the vertical flow path, means for connecting alternatively a vent line or a choke/kill line to said outlet passage provided in the controller housing wall, a lower telescoping spool having a lower connector means at its lower end for connection to structural casing or to a mandrel connected to a conductor string cemented within the structural casing and an upper connection means at its upper end for connection to the lower cylindrical opening of the fluid flow controller, and an upper telescoping spool having a lower connection means for connection to the upper cylindrical opening of the fluid flow controller.

2. The system of claim 1 wherein the lower connector means at the lower end of the lower telescoping spool is a overshot connection.

3. The system of claim 1 wherein the upper connection means at the upper end of the lower telescoping spool is a snap joint connector.

4. The system of claim 1 wherein the lower connection means of the upper telescoping spool is a snap joint connector.

5. The system of claim 1 further comprising dog means provided on said permanent housng for connecting the upper part of the upper telescoping spool to the permanent housing.

6. The system of claim 1 wherein the means for alternatively connecting a vent line or a choke/kill line to said outlet passage comprises a spool extending from said outlet passage, and a clamp means for connecting said spool to the vent line or alternatively to a choke/kill line.

7. A method for installing a system adapted for alternative use as a diverter or a blowout preventer for a bottom supported drilling rig beneath a permanent housing attached to rig structural members supporting a drilling rig rotary table after structural casing has been set in a borehole, the method comprising the steps of, lowering through the rotary table a collapsed spool having a lower connector means at its lower end and an upper connector means at its upper end, connecting the lower connection means at the lower end of the lower spool to the structural casing in the borehole, horizontally moving a fluid flow controller having a housing wall outlet and adapted for alternative use as a diverter or a blowout preventer to a drilling rig subsupport structure beneath the rotary table and fastening the controller to the subsupport structure after the controller is substantially vertically aligned with the bore of the rotary table above and the lower telescoping spool below, stroking the lower telescoping spool out until the connector means at its upper end connects with the lower end of the controller, lowering through the rotary table a collapsed upper telescoping spool having a lower connector means at its lower end and connecting the upper spool to the upper end of the controller by means of its lower connector means, and stroking the upper telescoping spool out until the upper end of the upper telescoping spool connects with the permanent housing.

8. The method of claim 7 wherein the connector means at the lower end of the lower spool is an overshot connection and the step of connecting the lower connection means at the lower end of the lower spool comprises the step of sliding the overshot connector over the end of the structural casing.

9. The method of claim 7 wherein the upper connector means at the upper end of the lower spool is a snap ring connector and the step of connecting the snap ring connector of the lower spool to the lower end of the controller comprises the step of sliding the upper end of the lower spool into a lower cylindrical opening of the controller until a snap ring of the snap ring connector snaps outwardly above an annular shoulder in the lower cylindrical opening of the controller.

10. The method of claim 7 wherein the lower connector means at the lower end of the upper spool is a snap ring connector and the step of connecting the snap ring connector of the upper spool to the upper end of the controller comprises the step of sliding the lower end of the upper spool into an upper cylindrical opening of the controller until a snap ring of the snap ring connector snaps outwardly below an annular shouder in the upper cylindrical opening of the controller.

11. The method of claim 7 wherein the permanent housing has dog latching means and the step of stroking out the upper telescoping spool until it connects with the permanent housing comprises sliding the upper end of the upper spool within the permanent housing and latching the dog latching means to secure the upper end of the upper spool within the permanent housing.

12. The method of claim 7 further comprsing the step of clamping a vent line connection to the wall outlet of the controller housing whereby the system which results may be used as diverter system for drilling the bore hole for a conductor string.

13. The method of claim 12 and after the well has been drilled for a conductor string and after the conductor string has been cemented in the well, further comprising, lifting the lower end of the lower telescoping spool, cutting off the conductor string, attaching a mandrel having the same outer diameter as that of the structural casing to the top of the conductor string, and lowering the lower end of the lower telescoping spool until the lower connection means of the lower spool connects with the mandrel, whereby the system which results may be used as a diverter during drilling through the conductor string.

14. The method of claim 13 wherein the lower connection means of the lower spool is an overshot connector and the step of connecting the lower connection means at the lower end of the lower spool comprises the step of sliding the overshot connector over the end of the mandrel.

15. The method of claim 13 further comprising the steps of, removing the clamped vent line connection at the wall outlet of the controller housing, installing a reducer hub to a choke/kill line, and clamping the reducer hub to the wall outlet of the controller housing, whereby the system which results may be used as a blowout preventer during drilling through the conductor string.

16. The method of claim 15 and after a smaller diameter casing has been cemented into the well, disconnecting the upper telescoping spool from between the flow controller and the rig permanent housing, raising the upper telescoping spool via the rotary table, disconnecting the flow controller from the lower telescoping spool and removing the flow controller to a stowed position of the substructure beneath the rotary table, removing the lower telescoping spool from the mandrel and raising the lower spool via the rotary table, installing a high pressure blowout preventer spool to the smaller diameter casing, installing a high pressure blowout preventer stack into position above the high pressure spool, and lowering the upper telescoping spool via the rotary table for connection between the high pressure blowout preventer stack and the rig permanent housing.

* * * * *